US005237136A

United States Patent [19]

Langston

[11] Patent Number: 5,237,136

[45] Date of Patent: Aug. 17, 1993

[54] HYDROSTATIC PRESSURE RESPONSIVE BYPASS SAFETY SWITCH

[76] Inventor: Thomas J. Langston, 503 Caliente St., New Iberia, La. 70560

[21] Appl. No.: 779,650

[22] Filed: Oct. 21, 1991

Related U.S. Application Data

[63] Continuation-in-part of Ser. No. 590,676, Oct. 1, 1990, abandoned.

[51] Int. Cl.[5] ..... H01H 35/38; E21B 43/116; F42C 15/00

[52] U.S. Cl. ..... 200/81 R; 200/61.69; 200/334; 175/2; 175/4.56

[58] Field of Search ..... 200/61, 69, 82 R, 334; 89/1.15; 166/299; 175/2, 4.52, 4.56

[56] References Cited

U.S. PATENT DOCUMENTS

| | | | |
|---|---|---|---|
| 3,758,731 | 9/1973 | Vann et al. | 200/61.69 |
| 4,266,613 | 5/1981 | Boop | 166/299 |
| 4,306,628 | 12/1981 | Adams, Jr. et al. | 175/4.56 |
| 4,967,048 | 10/1990 | Langston | 200/334 |

*Primary Examiner*—J. R. Scott
*Attorney, Agent, or Firm*—Bush, Moseley & Riddle

[57] ABSTRACT

In accordance with illustrative embodiments of the present invention, a safety bypass switch for use with explosive well tools includes a hollow conductive body having a copper conductor rod extending axially therethrough, a spring-loaded contact element movable transversely in the body between a first position where a surface of the element engages the rod to provide a solid short between the rod and the body, and a second position where such surface is out of engagement with the rod, and a diaphragm or piston for operating the contact element in a manner such that a predetermined hydrostatic pressure in the well bore will shift the contact element to the second position. The springs which bias the element toward the first position are mounted internally and externally of the body. In another embodiment of the invention a manually operated grounding switch is used in combination with the hydrostatic pressure operated switch to provide redundant assurance against accidental firing.

31 Claims, 2 Drawing Sheets

HYDROSTATIC PRESSURE RESPONSIVE BYPASS SAFETY SWITCH

CROSS-REFERENCE TO RELATED APPLICATION

This application is a continuation-in-part of application Ser. No. 590,676, filed Oct. 1, 1990 now abandoned.

FIELD OF THE INVENTION

This invention relates generally to a safety switch for preventing premature detonation of an explosive well tool, and particularly to a new and improved bypass safety switch that prevents an explosive well tool from being fired until the tool has been lowered past a predetermined depth in a fluid-filled well bore.

BACKGROUND OF THE INVENTION

Serious accidents and death have occurred by reason of premature detonation of explosive well tools such as perforating guns, casing or tubing cutters, string shot rods and jet cutters. These devices include powerful explosives that are extremely dangerous, and must therefore be handled with great care. As discussed in my application Ser. No. 483,355, filed Feb. 22, 1990, now U.S. Pat. No. 4,967,048, issued Oct. 30, 1990, explosive tools can fire accidentally due to various causes. The different switch embodiments disclosed in such patent prevent the arming of the tool until after the explosives have been positioned below the rig floor, so as to prevent accidental firing while the tool is being rigged up at the surface. While these switches represent significant advances in the art, there also is a great need for a switch that not only will prevent premature detonation at the surface, but also will prevent such detonation unless the explosive well tool is below a predetermined depth in the well bore. Thus not only is the tool disarmed until it has been lowered beyond such depth, the tool is automatically disarmed at such depth it is being withdrawn from the well, so that there is no danger of discharge of explosives at the surface that failed, for some reason, to fire in the well.

The general object of the present invention is to provide a new and improved bypass safety switch that will prevent firing of an explosive well tool until the tool and switch are submerged beyond a certain depth in a fluid-filled well bore.

Another object of the present invention is to provide a new and improved safety sub that operates to prevent flow of enough electric current to the detonator fuse of an explosive well tool unless the sub is being subjected to a predetermined hydrostatic pressure in a well bore.

SUMMARY OF THE INVENTION

These and other objects are attained in accordance with the concepts of the present invention through the provision of a safety switch apparatus comprising a hollow, metallic, tubular body having an electrical conductor rod extending through the interior thereof and adapted to provide an electrical connection between an armored electric cable and an explosive well tool, and contact means mounted on the body and arranged for movement between a first position engaging the conductor to short the same with respect to the body, and a second position out of contact with the conductor. The contact means is biased toward the first position with a predetermined pressure, and hydraulically operable means responsive to hydrostatic pressure in a well bore is provided for shifting the contact means from the first to the second position when such hydrostatic pressure overbalances the predetermined bias pressure. An amount of electric current sufficient to cause detonation of the fuse of the detonator can not flow through it and cause the same to explode until the contact means has been moved to the second position. In this manner firing of the tool can not occur until it has been lowered past a certain depth in the well, such as, for example, about one thousand feet. Since the contact means is biased toward its closed position with respect to the conductor rod with a predetermined pressure, as the switch and tool are being withdrawn from the well, the contact means automatically shifts back to the first position long before the tool arrives at the surface.

BRIEF DESCRIPTION OF THE DRAWINGS

The present invention has other objects, features and advantages that will become more clearly apparent in connection with the following detailed description of a preferred embodiment, taken in conjunction with the appended drawings in which.

DETAILED DESCRIPTION OF A PREFERRED EMBODIMENT

Figure 1:
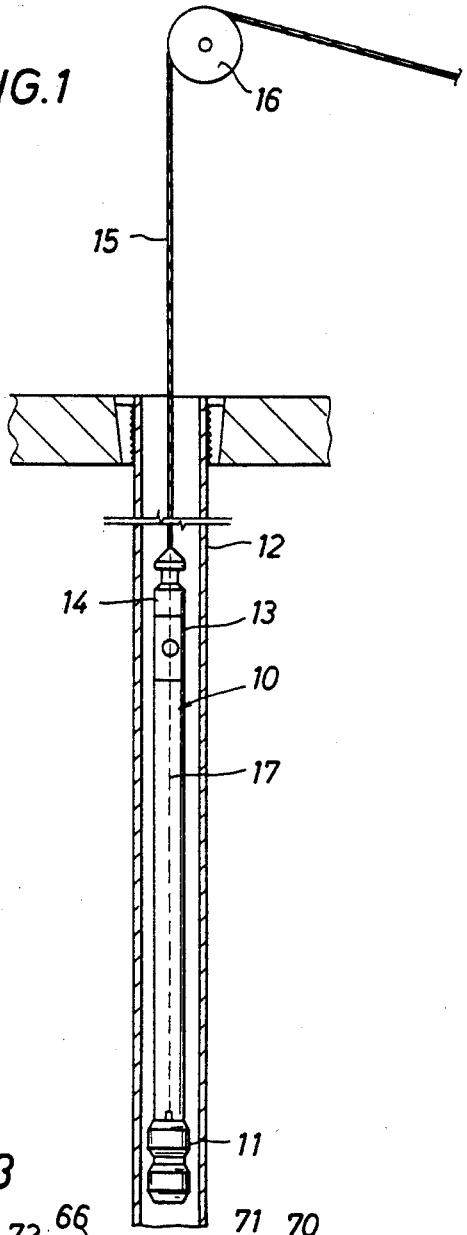
FIG. 1 is a schematic view of a well with an explosive well tool being lowered therein on an electric wireline.

FIG. 1 shows a wireline tool 10 that includes an explosive device 11 on its lower end being lowered into a well conduit 12, which may be casing, tubing or drill pipe. A bypass safety switch apparatus 13 that is constructed in accordance with the present invention is attached between the upper end of the tool 10 and a cable head 14 to which the electric wireline 15 is attached. The wireline 15 extends upward and over a sheave 16, and then outwardly away from the well head to the winch of a service truck (not shown). Typically the wireline 15 is a monocable that has a single insulated conductor wire in the center of a core, around which metal armor wires are laid to provide tensile strength. The conductor is coupled through a collector ring and brush arrangement on the winch spool to a power circuit on the truck. Such power circuit is provided with a normally-open firing switch that is turned on when it is desired to fire the explosive charge 11. The tool body and the armor wires of the cable 15 provide a ground return for current in the conductor wire 17.

The explosive tool 10 is shown in FIG. 1 as having been lowered into the fluid-filled well conduit 12 to a certain depth, such as 1000 ft., at which the safety switch 13 will automatically function to arm the tool 10 and enable it to be fired by an electrical signal on the cable 15. As will become more clearly apparent from the following description, until the tool 10 and switch 13 reach such depth, it is not practically possible to fire the tool 10.

Figure 2:
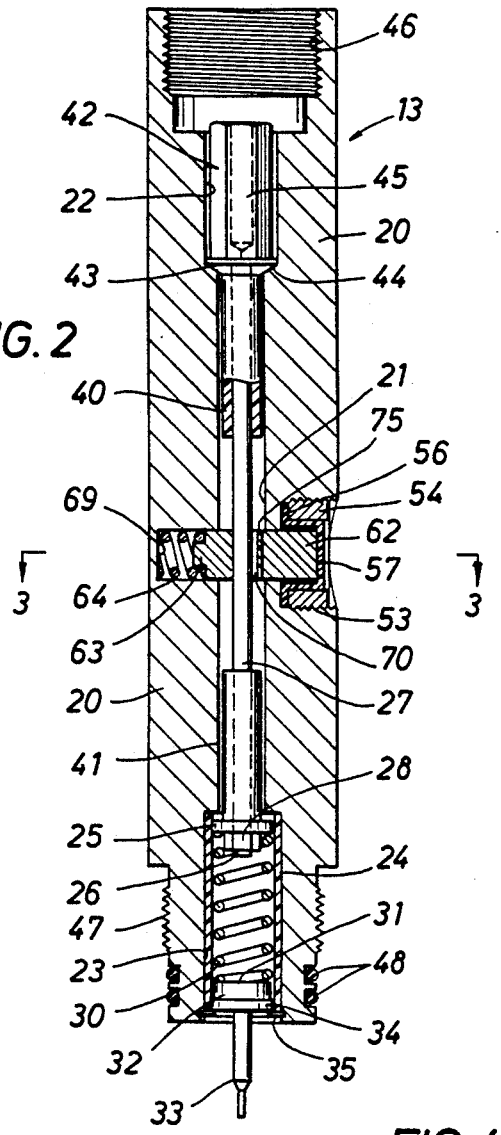
FIG. 2 is a longitudinal, sectional view of a bypass safety switch in accordance with the present invention.

As shown in FIG. 2, the switch apparatus 13 includes a tubular metallic body 20 having a central bore 21 extending therethrough, such bore having enlarged diameter portions 22 and 23 at its opposite end. Fitted within the portion 23 is an insulator sleeve 24 and an insulating washer 25, the washer being received on the externally threaded end portion 26 of a copper conductor rod 27 that extends axially of the body 20. A metal nut 28 is threaded onto the end portion 26 and bears against the washer 25. An electrically conductive coil spring 30 has its outer end in contact engagement with an inner surface 31 of a circular base 32, and its inner end portion in contact engagement with outer surfaces of the nut 28. The base 32 has an integral contact pin 33 extending downward therefrom. An insulator washer 34 fits over the pin 33 and is secured within the sleeve 25 by a split retainer ring 35 that is received within an internal annular groove in the body 20. The pin 33 is adapted to be received within a suitable socket of a mating electrical connector (not shown) at the upper end of the explosive tool 10.

The conductor rod 27 has its opposite end portions covered by insulator sleeves 40 and 41, leaving a central portion of the rod exposed. A suitable female contact assembly 42 is received within the enlarged diameter bore portion 22 of the body 20, and is connected to the upper end of the rod 27. A frusto-conical insulator washer 43 fits against an internal shoulder 44. The contact assembly 42 has an elongated socket 45 (shown in phantom lines) that is adapted to receive the prong of a mating electrical connector (not shown) on the cable head 14. The upper end section of the body 20 is internally threaded at 46 so that it can be screwed onto the lower end of the cable head 14. The lower end portion of the body 20 is provided with a male coupling including threads 47 and seal rings 48 which enable the body 20 to be screwed into the upper end of the body of the explosive well tool 10.

Figure 3:
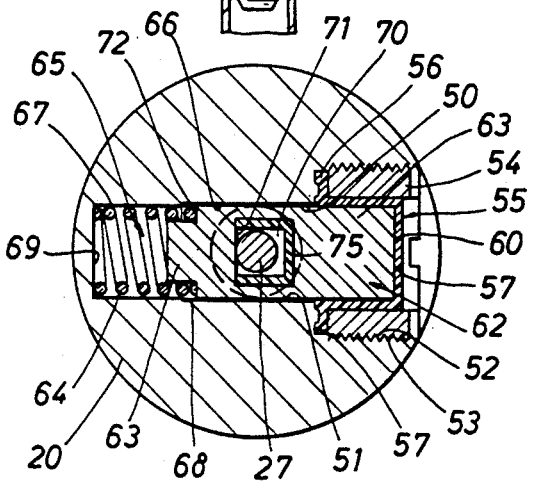
FIG. 3 is a cross-section on line 3—3 of FIG. 2.
Figure 4:
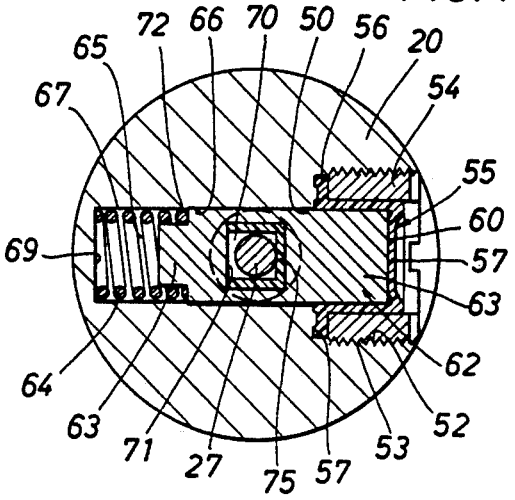
FIG. 4 is a cross-section similar to FIG. 3, but with the contact member moved to the second position.

The pressure responsive switch mechanism is shown in side section in FIG. 2, and in cross-section in FIGS. 3 and 4. A bore 50 which extends radially through the wall of the body 20 has a lesser diameter inner portion 51 and a greater diameter outer portion 52. The outer portion 52 is threaded at 53 to receive a lock nut 54. An elastomer, cup-shaped member 55 has an outwardly directed flange or lip 56 that is held in sealing engagement with the outwardly facing shoulder 57 by the nut 54. The outer wall 58 of the cup member 56 is compliant, and functions like a diaphragm to transmit hydrostatic well pressures to the outer surface 60 of a movable contact member 62. The radially outer portion 63 of the contact member 62 is received for free sliding movement within the inner bore portion 51 of the body 20.

Another radial bore 65 is formed in the body 20 opposite the bore 50. This bore does not extend through the wall of the body 20, so as to provide an inwardly facing wall surface 69. The bore 65 has an enlarged diameter inner section 66 and a reduced diameter outer section 67 to provide an annular, inwardly facing shoulder 66. The inner portion of the contact member 62 slides in the bore section 66, and has a reduced diameter boss on its end which provides a guide for the inner end of a compressed coil spring 64. The coil spring 64 reacts between a shoulder surface 72 of the contact member 62 and the wall surface 69 at the back of the bore 65.

The conductor rod 27 extends through an opening 70 in the contact member 62. The opening 70 can have various shapes so long as its definitive dimensions are substantially greater than the outer diameter of the rod 27. In this manner there can be substantial clearance between the rod 27 and the various sides of the opening 70 when the opening is positioned centrally of the rod. The contact member 62 can move between a first position shown in FIGS. 2 and 3 where the side wall surface 71 of the opening 70 engages the rod 27, and a second position shown in FIG. 4 where there is clearance, for example ⅛ inch, between all outer surfaces of the rod and each of the walls that define the opening 70. A U-shaped insulator member 75 can be positioned in the opening 70 so as to inhibit arcing of current between the rod 27 and the adjacent wall surfaces of the opening 70.

The engagement of the shoulders 72 and 68 ensure that the contact member 62 will not advance past the second position shown in FIG. 4. Alternatively, the bias spring 64 can be designed to have a fully-stacked length which causes it to stop inward movement of the contact member 62 in the second position.

Although friction between diaphragm cup 55 and the outer portion 63 of the contact member 62, and between the preloaded spring 64 and the shoulder 72 of the contact member, can be relied upon to prevent undesired rotation of the contact member relative to the bore 50, an arrangement such as a key on the contact member that slides in a transverse groove in the body 20 can be used to prevent such relative rotation.

OPERATION

To assemble the switch apparatus 13, the spring 64 is dropped into the bore portion 67, and then the contact member 62 is inserted into the bore 50 with the axis of the opening 70 aligned with the longitudinal axis of the body 20. The elastomer cap member 55 is then pushed over the outer portion 63 of the contact member 62 until the seal flange 56 rests against the shoulder 57. The nut 54 is threaded in and tightened to prevent any fluid leakage between the seal flange 56 and the shoulder 57. The contact member 62 then is pushed inward to about the position shown in FIG. 4, and the conductor rod 27 having the insulator sleeve 40 thereon is inserted through the opening 70 until the female connector part 42 is seated against the body shoulder 44. The lower insulator sleeve 41 is then positioned on the lower end portion of the rod 27 as shown in FIG. 2, after which the contact member 62 is released so that the bias spring 64 forces the side wall surface 71 of the opening 70 into engagement with the rod 27 as shown in FIGS. 2 and 3. The various parts of the male connector assembly at the lower end of the body 20 are positioned and assembled as shown in FIG. 2. The threads 47 on the lower end of the body 20 then are screwed into companion threads at the upper end of the body of the explosive well tool 10, and the cable head 14 is screwed into the threads 46 at the upper end of the body 20. The metal-to-metal contact between the element 62 and an outer surface of the conductor rod 27 provides what may be referred to as a solid short between the rod and the body 20 via the bias spring 64 and the various opposed wall surfaces of the contact member the body bore 50.

The bias spring 64 is under a predetermined amount of compression so that it will not collapse further until such preload force is exceeded. The pressure of the spring 64 causes the surface 71 of the opening 70 to engage the adjacent outer wall of the contact rod 27 to thereby ground the rod to the body 20 via the coil spring 64. With the switch apparatus 13 in this configuration, the body 20 is attached to the upper end of the explosive well tool 10 by engaging the threads 47 therewith. Since the switch 13 is in the safe position, the cable head 14 also can be made up with the threads 46. The tool is then raised to the vertical, and lowered into the well conduit 12. During all such assembly and handling, a stray electrical current from any source, or any static charge induced in the cable by any source, will be shorted to ground through the contact member 62, the coil spring 64, the body 20, the cable head 14 and the armor wires of the cable 15.

As the explosive tool 10 is lowered into the well conduit 12, the diaphragm portion 57 of the cap member 55 transmits the increasing hydrostatic pressure to the outer end surface 60 of the contact member 62. Such increasing pressure is opposed by the preload pressure of the coil spring 64 to initially maintain the contact member 62 in the first position as shown in FIG. 3. However, when a well depth is reached at which the hydrostatic pressure exceeds the spring preload pressure, the contact member 62 will be forced to shift to its second position shown in FIG. 4 where the rod 27 does not contact the wall surface 71 of the contact member 62. This automatically arms the explosive well tool 10 downhole so that it can be fired by an electric signal from the surface. The well depth at which the tool 10 is armed can be, as mentioned before, about 1000 feet, although other depth settings that are well below the surface can be employed.

In order to arm the explosive well tool 10 at a different depth than the depth mentioned above, a bias spring having a different rate than spring 34 can be substituted, so that a different hydrostatic pressure is required to overbalance the spring. However, applicant believes that using the embodiment shown in FIG. 2 a single depth setting of about 1000 feet is preferable to accomplish the overall purposes on the present invention, which is to ensure that the explosive well tool can not be fired until it is well below the surface.

A secondary advantage to use of the present invention is that the switch apparatus 13 will ground the conductor rod 27 to the body 20 as the tool 10 is raised above a depth of 1000 feet during withdrawal. If there is any explosive device, such as a shaped charge, which did not in fact detonate on command, the safety switch 13 prevents accidental firing thereof as the tools are being disassembled and handled at the surface.

As discussed in connection with FIG. 8 of my above-mentioned U.S. Pat. No. 4,967,098, the efficacy of the present invention can be demonstrated as follows. The cable current is equal to the fuse current times the sum of the resistance of the connector spring 30 and the resistance of the detonator fuse, divided by the resistance of the contact between the member 62 and the rod 27. In practice, this later resistance has a value of about 0.001 ohm, and the spring 30 has a resistance of about 0.052 ohm. The resistance of a typical detonator fuse is about 1.0 ohm, and the current needed to explode the fuse is about 0.5 to 0.8 amps. A current level of 0.2 amp and below will not cause firing. It will be recognized that even if the fuse resistance is zero, cable current will be bypassed through the safety switch 13 in a ratio of 52:1, and that in practice the current bypass is much greater due to the non-zero resistance of the fuse, or any other resistance that is in series therewith, such as the resistance of the spring contact 30. Thus when the bypass safety switch 13 is closed, there must be a stray cable current of at least 210 amps to produce a fuse current of 0.2 amp. The requirement of such a high stray or induced current level affords complete protection against all but the most abnormal of possible events.

Figure 5:
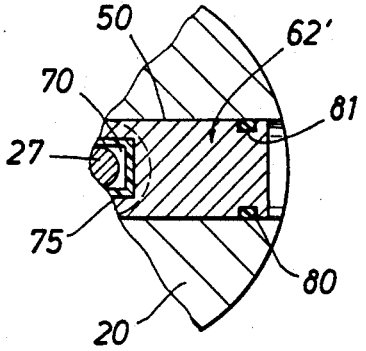
FIG. 5 is a fragmentary cross-sectional view of another embodiment of the present invention.

Another embodiment of the present invention is shown in FIG. 5. Instead of the elastomer cap member 55 that is retained by the threaded nut 54, an O-ring 80 is mounted in an external groove 81 in the contact member 62' and sealingly engages the inner wall of the bore 50 which is extended to the outside of the body 20. The hydrostatic pressure in the well bore outside the body 20 acts on a transverse cross-sectional area defined by the diameter of sealing engagement of the O-ring 80 to produce inward force on the contact member 62' that opposed the bias of the coil spring 64. The contact member 62' is retained in the bore 50 by reason of the fact that the rod 27 is extended through the opening 70 during assembly of the apparatus. When the rod 27 engages the wall 71 of the opening 70 as in FIG. 3, the spring 64 is compressed an preloaded the necessary amount.

Figure 6:
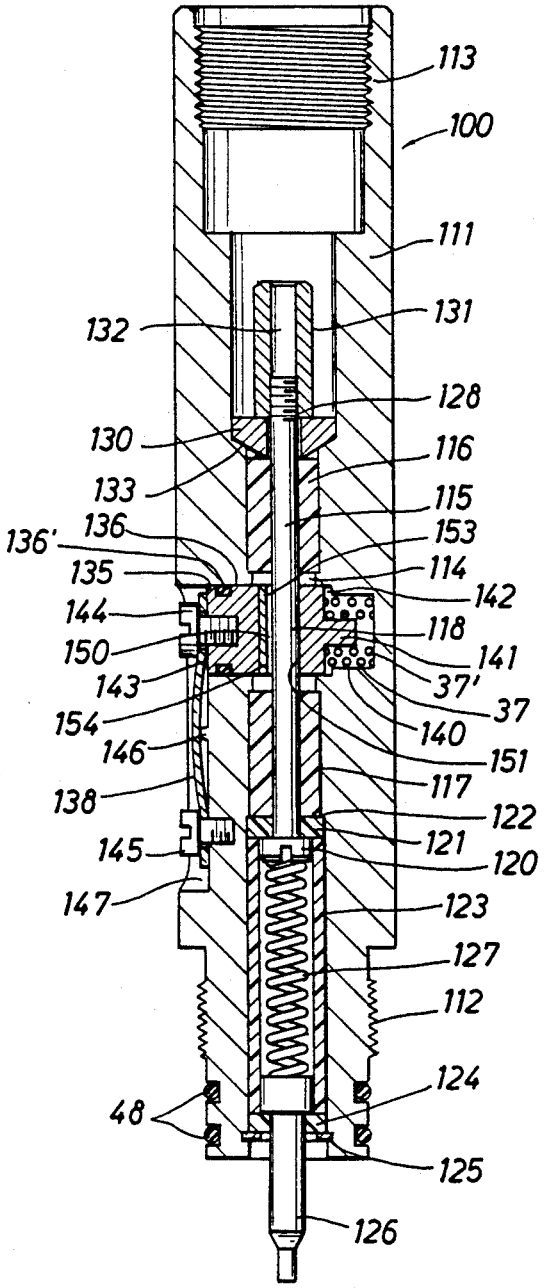
FIG. 6 is a longitudinal cross-sectional view of yet another embodiment of this invention requiring greater hydrostatic pressure to activate the switch.

As shown in FIG. 6, another embodiment of a safety switch sub 100 which incorporates the principles of the present invention includes a generally tubular body 111 having a threaded pin 112 at its lower end and a threaded box 113 at its upper end. This embodiment has a unique bias spring arrangement that enables the explosive tool 10 to be lowered to a relatively great depth in the borehole before the tool is armed. A longitudinal opening or bore 114 extends throughout the body 111. An electrically conductive rod or pin member 115 is mounted in the bore 114 by upper and lower insulator sleeves 116, 117 whose inner ends are spaced apart to leave a bare or exposed section 118 of the pin member 115 therebetween. The head 120 of the pin member 126 rests against a insulator washer 121, which is held against an internal shoulder 122 by an insulator sleeve 123. The lower end of the sleeve 123 engages another insulator washer 124 which is retained by a clip ring 125. A contact member 126 is biased downward through the washer 124 by a metal coil spring 127 whose upper end bears against the lower surface of the head 120 to complete an electrical circuit between the contact 126 and the conductive pin member 115. The upper end portion 128 of the pin member 115 is received in a conical insulating washer 130, and a metallic nut 131 is screwed onto such end portion. The nut 131 has an internal bore 132 which receives an electrical contact member (not shown) on the lower end of the cable head 14 which is screwed into the box 113. The washer 130 engages a shoulder 133 in a manner such that the nut 131 can be tightened to place the pin member 115 under tension.

To selectively ground the pin member 115 to the body 111, and thus to the armor wires of the electrical cable 15 on which the explosive tool 10 suspended, until such time as the explosive tool has been lowered quite deep into a well bore, a laterally shiftable piston member 135 is provided. The piston member 135 is received in a transverse bore 136 which intersects the opening 114 through the body 111. The outer end of the piston 135 carries an O-ring seal 136 that prevents fluid leakage therepast, so that the hydrostatic pressure in the well bore tends to shift the piston inward.

Such inward movement is opposed by a spring system including internal coil springs 37, 37' and an external leaf spring 138. The coil springs 37, 37' are nested in a reduced diameter bore 140, and their inner portions encircle a guide 141 on the inner end of the piston 135. Thus these springs react between the outer wall of the bore 140 and a shoulder 142 on the inner end of the piston 135. The upper end of the leaf spring 138 is secured to the outer end face 143 of the piston 135 by a screw 144, and the lower end thereof is attached to the body 111 by a screw 145. The mid-portion of the leaf spring 138 is supported by an outwardly directed shoulder 146 on the body 111 which provides a fulcrum. The leaf spring 138 preferably is located in a longitudinal external recess 147 so that its outer surface, and the heads of the screws 144, 145 do not protrude beyond the outer periphery of the body 111.

An opening 150 is formed in the piston 135 and has a transverse dimension that is larger than the outer diameter of the pin member 115, which extends through the opening as shown. The opening 150 can have the same general cross-sectional shape as the opening shown in FIGS. 3 and 4, or the opening can be round. The springs 37, 37' and 138 are preloaded during assembly so that the side surface 151 of the opening 150 is forced against the adjacent outer surface 152 of the pin member 115 to ground the pin member to the body 111. Such preloading can be accomplished by manually forcing the piston member 135 inward to partially collapse the coil springs 37, 37', and to partially deflect the leaf spring 138 about the fulcrum shoulder 146, and then inserting the pin member 115 through the opening 150. The engagement of the surface 151 with the pin member 115 keeps the springs from fully relaxing, so that they exert a resultant outward bias force on the piston member 135. When the explosive tool 10 has been lowered to a sufficient depth in the well bore 12, hydrostatic pressure acting on the transverse cross-sectional area of the piston member 135 at the seal 136 produces an inward force that exceeds the preload bias forces of the springs 37, 37' and 138. When this occurs, the piston member 135 shifts inward against the combined influences of these springs to break the contact between the surface 151 and the pin member 115. An insulator member 153 is secured to the opposite wall 154 of the opening 150 to prevent the pin member 115 from again grounding to the body 111 should the hydrostatic pressure forces become great enough to move the opposite side of the opening 150 against the opposite side of the pin member. Where the shape of the opening 150 is polygonal as shown in FIGS. 3 and 4, the insulator 153 will be U-shaped. Where the opening 150 is circular, the member 53 can be generally semi-circular.

In operation, the safety switch sub 100 is assembled as shown in FIG. 6, and the preload forces of the coil springs 37, 37' and the leaf spring 138 hold the piston member 135 in its outer position where the surface 151 of the opening 150 engages the adjacent surface on the bare section 118 of the pin member 115 to ground the pin member to the body 111 and provide a solid short therebetween. Then the threaded pin connection 112 is made up to the explosive well tool 10, and the box connection 113 is secured to the cable head 14. As the pin coupling 112 is made up, the contact 126 automatically enters a companion socket in the tool 10, and a similar pin on the cable head 14 enters the socket 132 in the nut member 131. So long as the surface 151 on the piston member 135 is engaged with the pin member 112, the explosive well tool 10 cannot be fired. For an equivalent circuit showing how this effect is achieved, refer to FIG. 8 of my U.S. Pat. No. 4,967,048, and the corresponding explanation in the specification, which is incorporated herein by express reference.

As the well tool 10 is lowered into the fluid-filled well bore 12, the hydrostatic pressure acting inward on the outer face of the piston member 135 becomes increasingly greater, producing a gradually increasing inward force thereon. The pre-load of the springs 37, 37' and 138 provides a net outward force on the piston 131 until the well tool 10 has been lowered beyond a fairly great depth in the well, for example 3–5000 feet. Once the hydrostatic pressure force predominates over the combined spring forces, the piston 135 shifts inward to eliminate the contact between the surface 151 and the pin section 118. This arms the well tool 10 for firing in response to an electrical signal applied to the cable 15 at the surface. Even though the piston 135 is shifted inward enough to engage the pin section 118 with the insulator member 153, the tool 10 remains armed due to the nonconductive nature of such insulator member.

After the explosive well tool 10 has been fired by closing a switch at the service truck, and is being raised back up to the surface, at about the same depth as the tool was armed by operation of the sub 100, the springs 37, 37' and 138 over-balance the inward force on the piston 135 due to hydrostatic pressure, and the piston 135 shifts outward to again engage the surface 151 with the pin member to ground the pin member 115 to the body 100. Thus if for some reason the explosive well tool 10 failed to completely discharge, the risk of accidental firing at the surface is substantially eliminated. This is because any current applied to the conductor inside the cable 15 will pass to ground via the body 111 and the armor wires of the cable 15, rather than passing through the firing squib or detonator in the tool 10.

Figure 7:
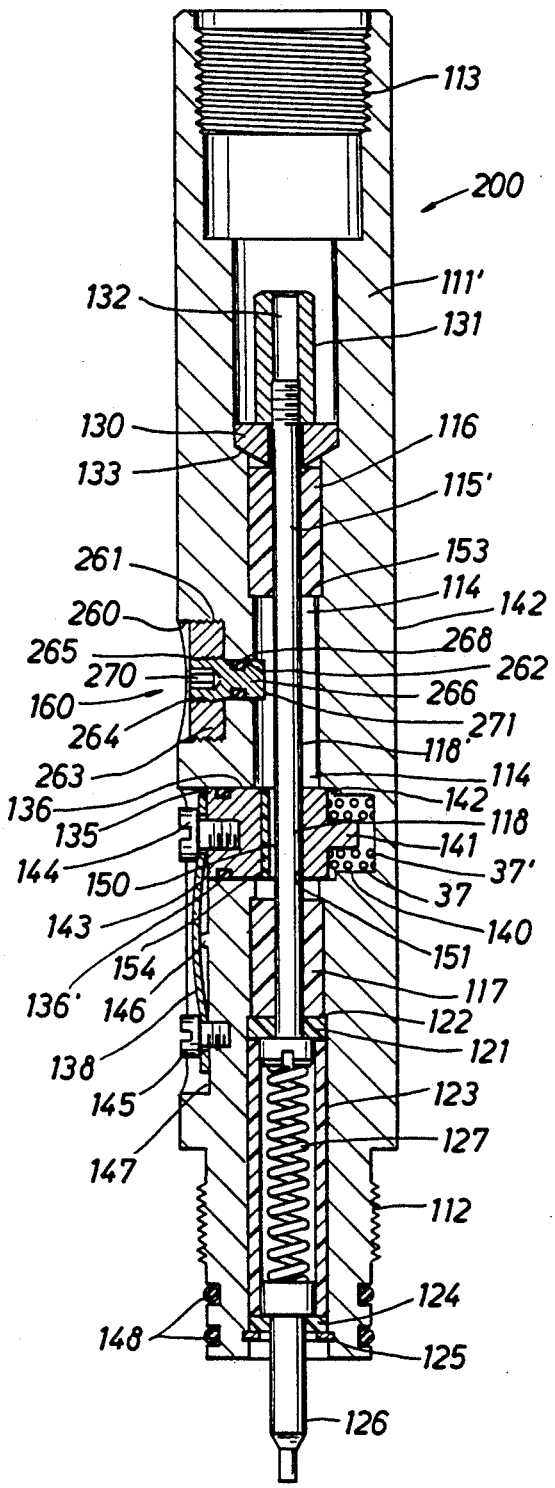
FIG. 7 is a view similar to FIG. 6 of an embodiment that combines hydrostatic and mechanical operation.

Still another embodiment of the present invention is shown in FIG. 7. This embodiment combines the hydrostatic pressure responsive safety switch system, as described above, with a manually operated safety switch indicated generally at 160. The switch 160 is similar to that disclosed and claimed in my U.S. Pat. No. 4,967,048. To the extent that the parts illustrated in FIG. 7 are identical to those parts described above, they have been given the same reference numerals. For a combined hydrostatic/manual operated safety sub 200, the body 111' is made somewhat longer, as is the conductor pin 115', so that the length of the bare section 118' thereof is increased as shown. A counterbore 260 is formed radially through the wall of the body 111' adjacent the piston member 135, and has an outer threaded section 261 and an inner smooth section 262. A nut 263 is threaded into the outer section 261, and the nut has a threaded central bore 264 which receives the threads on the outer portion 265 of a contact member or plug 266. The inner portion of the plug 266 carries an O-ring 268 which sealingly engages the wall of the bore section 262 to prevent fluid leakage. A polygonal recess 270 is formed in the outer portion 265 of the plug 266 so that it can be rotated by an appropriate hand tool such as an allen wrench.

In operation, the contact plug 266 is turned in one rotational direction to advance it inward until its inner end surface 271 engages the outer wall surface of the conductor pin 115' before the safety switch sub 200 is connected between the cable head 14 and the explosive well tool 10. Thus the conductor pin 115' is grounded to the body 111' by both the contact plug 266 and the piston 135 to provide redundant assurance against premature or accidental firing as the tool 10 is rigged up at the surface. The seals 48 on the pin connection 112 and similar seals on the cable head 14 that seat in the box connector 113, together with the plug and piston seals 268 and 136 maintain the inner bore 114 of the sub 200 at atmospheric pressure. As the tool 10 is being lowered thorough the rig floor, it is stopped in a vertical position where the contact plug 266 is still accessible, and the plug is screwed outward to break its contact with the conductor pin 115'. At this point the explosive well tool 10 is well below the top of the rig floor, so that should accidental firing occur, there will be no harm to personnel who are rigging up and running the tool. However, the chance of any such firing is extremely small to nonexistent due to engagement of the piston surface 151 with the bare surface 118' of the conductor pin 115', which continues to cause grounding of the pin to the body 111'. As the tool 10 is lowered into the well bore on the armored electric cable 15, at a predetermined depth the hydrostatic pressure force acting on the piston 135 will over-balance the combined forces of the preloaded springs 37, 37' and the leaf spring 138 so that the surface 151 moves away from the external surface of the bare section 118'. At this point the explosive well tool is armed and can be fired on command from the surface.

As the tool 10 is being withdrawn from the well, the piston 135 experiences a gradual reduction in the hydrostatic pressure which acts on its outer face, and the piston will shift outward until the surface 151 reengages the conductor pin 115' at a depth that is far below the surface, and which will be at about the same depth at which the tool 10 was armed during lowering. Such engagement grounds the conductor pin 115' to the body 111' and thus to the armor wires of the cable 15. When the tool 10 reaches the rig floor, it is halted when the contact plug 266 is first exposed to view. Then a hand tool is used to advance the contact plug 266 inward until its inner end engages the conductor pin 115' to provide an additional ground between the conductor pin and the body 111'. Hereagain there is redundant assurance that if the tool 10 still has one or more explosive charges which were not fired at depth, they cannot be fired accidentally at the surface as the system is being rigged down.

It now will be recognized that new and improved bypass safety switches have been disclosed which meets all the objectives and have all the features and advantages of the present invention. Since certain changes or modifications may be made in the disclosed embodiments without departing from the inventive concepts involved, it is the aim of the appended claims to cover all such changes and modifications falling within the true spirit and scope of the present invention.

What is claimed is:

1. A safety switch apparatus for use with an explosive well tool to prevent accidental or premature firing thereof, comprising: a hollow conductive body; conductor means extending through said body and adapted for conducting electric current to said well tool to fire the same; pressure operated contact means on said body arranged for movement between a first position engaging said conductor means and a second position disengaged therefrom; and means responsive to a predetermined level of hydrostatic pressure in a well for shifting said contact means from said first position to said second position.

2. The apparatus of claim 1 further including means for biasing said contact means toward said first position with a selected pressure level, whereby said contact means can not shift toward to second position until said hydrostatic pressure level exceeds said selected pressure level.

3. The apparatus of claim 2 wherein said biasing means includes compressed coil spring means reacting between said body and said contact means.

4. The apparatus of claim 1 wherein said shifting means comprises a diaphragm member on said body having one side engaging said contact member and its other side exposed to said hydrostatic pressure.

5. The apparatus of claim 1 wherein said shifting means includes seal means on said contact means engaging said body for preventing fluid leakage between said contact means and said body.

6. The apparatus of claim 1 where said contact member has an opening therein, said conductor means extending through said opening, said opening having a larger transverse dimension that said conductor means so that a wall surface of said opening can engage said conductor means in said first position and be disengaged therefrom in said second position.

7. A safety switch apparatus for use with an explosive well tool to prevent accidental or premature firing thereof, comprising: a hollow conductive body having one end adapted to the coupled to an explosive well tool and another end adapted to be coupled to a cable head on the end of an armored electric cable; a conductor rod extending axially of said body and adapted to conduct electric current from said cable to said well tool to fire the same; said body having a radially arranged bore extending through a wall thereof; an elongated, cylindrical, pressure operated contact member mounted for transverse movement in said bore between a first position and a second position, said contact member having an opening through which said conductor rod extends, a wall surface of said opening engaging said conductor rod in said first position and being disengaged therefrom in said second position; means for biasing said contact member toward said first position with a preselected pressure; and means for subjecting said contact member to the hydrostatic pressure in a well bore, so that a predetermined level of said hydrostatic pressure will overbalance said biasing means and shift said contact member to said second position.

8. The apparatus of claim 7 wherein said biasing means includes coil spring means that reacts between said body and a shoulder on said contact member, said coil spring means being under compression so as to exert a predetermined pressure against said contact member in said first position.

9. The apparatus of claim 7 wherein said subjecting means comprises a diaphragm element mounted on said body and arranged to close said bore, said diaphragm element having an outer surface exposed to well fluids and an inner surface engaging said contact member.

10. The apparatus of claim 7 wherein said subjecting means comprises a seal ring on said contact member arranged to sealingly engage the wall of said bore, said contact member having an outer surface exposed to said hydrostatic pressure.

11. The apparatus of claim 9 wherein said diaphragm element has a cup-like shape and is arranged to fit over an outer end portion of said contact member, said element having an outwardly directed flange; and further including lock nut means threaded to said body and engaging said flange to provide a compression seal of said flange against said body.

12. The apparatus of claim 7 further including insulator means in said opening to prevent passage of electrical current between said conductor rod and all surfaces of said opening other than said wall surface.

13. The apparatus of claim 11 wherein said contact member has an overall length such that when said lock nut seals said flange against said body, said diaphragm element moves said contact member inward to compress said coil spring means by said predetermined amount.

14. The apparatus of claim 7 wherein said opening in said contact member is substantially square, the side dimensions of said square being greater than the outer diameter of said conductor rod so that in said second position there is no engagement between any surface of said opening and any surface of said rod.

15. A safety switch system for use with an explosive well tool, comprising; a hollow conductive body; conductor means extending through said body for conducting electric current to said well tool to fire the same; piston means on said body having contact means and movable between a first position where said contact means engages said conductor means to ground said conductor means to said body, and a second position where said contact means is disengaged from said conductor means; and external spring means for biasing said piston means toward said first position, said piston means being responsive to hydrostatic pressure in a well bore for overbalancing the bias of said spring means and moving said contact means out of engagement with said conductor means.

16. The system of claim 15 further including internal spring means also biasing said piston means toward said first position.

17. The system of claim 16 wherein said external spring means includes an elongated leaf spring having opposite end portions, one of said end portions being fixed to said body and the other of said end portions being fixed to said piston means.

18. The system of claim 17 further including longitudinal recess means in the exterior of said body for receiving said spring member.

19. The system of claim 18 further including an outwardly directed shoulder in said recess means providing a fulcrum point that engages said spring member between said opposite end portions.

20. The system of claim 19 wherein said internal spring means comprises at least one compression coil spring reacting between said body and said piston means.

21. A safety switch system for use with an explosive well tool, comprising; a body having insulated conductor means therein, said conductor means having a bare surface between its ends; piston means on said body and having a contact surface movable between a first position where said contact surface engages said bare surface to ground said conductor means to said body and a second position where said surfaces are out of engagement; spring means for biasing said piston means toward said first position, said piston means being responsive to hydrostatic pressure in a well bore for overbalancing said spring means and moving said piston means to said second position; and a contact member on said body movable between a first position where a contact surface thereon engages said bare surface to provide an additional ground of said conductor means to said body and a second position where said contact surface is out of engagement with said bare surface, said contact member being manually operated between its first and second positions.

22. The system of claim 21 wherein said spring means including internally and externally mounted spring members for biasing said piston means toward said first position.

23. The system of claim 22 wherein said externally mounted spring means includes an elongated spring member having opposite end portions, one of said end portions being fixed to said body and the other of said end portions being fixed to said piston means.

24. The system of claim 23 further including longitudinal recess means in the exterior of said body for receiving said spring member.

25. The system of claim 24 further including an outwardly directed shoulder in said recess means providing a fulcrum point that engages said spring member between said opposite end portions.

26. The system of claim 22 wherein said internal spring means comprises at least one compression coil spring reacting between said body and said piston means.

27. The system of claim 21 wherein said contact member includes a plug having external threads that mesh with companion threads on said body, so that rotation of said plug in one hand direction causes movement to said first position and in the opposite hand direction causes movement to said second position; and means on said plug enabling rotation thereon by a suitable hand tool.

28. A safety switch for use with an explosive well tool, comprising: an elongated generally tubular body having insulated conductor means therein, said conductor means having a bare section between its ends; manually operated first means selectively engageable with said bare section for grounding said conductor means to said body to prevent firing of an explosive well tool and being disengageable therefrom to break said grounding and permit said firing; and hydrostatic pressure responsive second means engageable with said bare section to provide an additional ground connection between said conductor means and said body that prevents firing of an explosive well tool until the tool has been lowered to a predetermined depth in a fluid-filled well bore at which said additional ground connection is broken to permit said firing.

29. A method of arming an explosive well tool only after it has been lowered past a predetermined depth in a fluid-filled well bore on an armored electric cable, comprising the steps of: providing a normally closed switch at the upper end of said well tool that provides a path whereby electric current in said cable can be shorted to ground; biasing said switch to said normally closed position with a predetermined bias pressure; opposing said predetermined bias pressure with increasing hydrostatic pressure as the tool is lowered into the well; and opening said switch when said hydrostatic pressure overbalances said predetermined bias pressure to eliminate the short to ground.

30. The method of claim 29 including the further step of automatically reclosing said switch at approximately said depth to reestablish said short to ground as the tool is being withdrawn from the well and said predetermined bias pressure again predominates over said hydrostatic pressure.

31. The method of claim 30 including the further steps of providing a manually operated switch at the upper end of said well tool for providing additional shorting of electric current in said cable to ground; operating said manually operated switch to provide an additional path whereby electric current in said cable is shorted to ground as said well tool is being rigged up; and opening said manually operated switch to eliminate said additional path after the explosive well tool is below the rig floor.

* * * * *